US009318804B2

(12) United States Patent
Weckerle et al.

(10) Patent No.: US 9,318,804 B2
(45) Date of Patent: Apr. 19, 2016

(54) METHOD AND APPARATUS FOR POWER LOSS COMPENSATION AND SUPPRESSION OF SIDELOBES IN ANTENNA ARRAYS

(71) Applicants: Martin Weckerle, Ulm (DE); Dirk Neumann, Ulm (DE)

(72) Inventors: Martin Weckerle, Ulm (DE); Dirk Neumann, Ulm (DE)

(73) Assignee: KATHREIN-WERKE KG, Rosenheim (DE)

( * ) Notice: Subject to any disclaimer, the term of this patent is extended or adjusted under 35 U.S.C. 154(b) by 0 days.

(21) Appl. No.: 13/934,025

(22) Filed: Jul. 2, 2013

(65) Prior Publication Data

US 2013/0293409 A1 Nov. 7, 2013

Related U.S. Application Data

(63) Continuation of application No. 12/415,195, filed on Mar. 31, 2009, now abandoned.

(60) Provisional application No. 61/040,887, filed on Mar. 31, 2008.

(30) Foreign Application Priority Data

Mar. 31, 2008 (GB) ..... 0805826.5

(51) Int. Cl.
*H01Q 3/26* (2006.01)
*H01Q 3/24* (2006.01)
*H01Q 1/24* (2006.01)

(52) U.S. Cl.
CPC ..... *H01Q 3/267* (2013.01); *H01Q 1/246* (2013.01); *H01Q 3/2605* (2013.01)

(58) Field of Classification Search
USPC ..... 342/379, 372
IPC ..... H01Q 1/246,3/2605, 3/267
See application file for complete search history.

(56) References Cited

U.S. PATENT DOCUMENTS 5,017,927 A 5/1991 Agrawal et al.
5,151,706 A * 9/1992 Roederer et al. ..... 342/372
(Continued)

FOREIGN PATENT DOCUMENTS

EP 367167 5/1990
EP 1158824 11/2001
(Continued)

OTHER PUBLICATIONS

M. Levitas et al., Practical failure compensation in active phased arrays, IEEE Transactions on Antennas and Propagation, vol. 47(3), p. 524-535, Mar. 1999.*
D. Parker et al, Phased arrays—part 1: theory and architectures, IEEE Transactions on Microwave Theory and Techniques, vol. 50(3), p. 678-687, Mar. 2002.*
Array antenna. (1999). In Focal dictionary of telecommunications, focal press. Retrieved from http://search.credoreference.com/content/entry/bhfidt/array_antenna/0.*
(Continued)

*Primary Examiner* — Tashiana Adams
*Assistant Examiner* — Fred H Mull
(74) *Attorney, Agent, or Firm* — Stephen H. Eland; Dann, Dorfman, Herrell & Skillman

(57) ABSTRACT

An antenna array for the transmission of signals is disclosed which comprises a plurality of antenna elements connected to a plurality of transceivers. The plurality of transceivers receive transceiver signals for transmission to the plurality of antenna elements. The antenna comprises a failure detector or monitoring and control system connected to the plurality of transceivers, which autonomously detects malfunction of the individual transceivers and reports this to the signal processor without involvement of the transmitter and receiver. The antenna array also comprises a signal processor connected to the plurality of transceivers and adapted to weight using complex values the transceiver signals for automatically compensating for power losses by tilt adjustments and for interference by suppression of sidelobes of the signals based on the information from the failure detector or monitoring and control system.

13 Claims, 4 Drawing Sheets

(56) References Cited

U.S. PATENT DOCUMENTS

| | | | | |
|---|---|---|---|---|
| 5,515,060 | A | 5/1996 | Hussain et al. | |
| 5,610,792 | A * | 3/1997 | DeShazo | 361/103 |
| 6,339,398 | B1 | 1/2002 | Redvik et al. | |
| 7,133,683 | B1 * | 11/2006 | Budney et al. | 455/456.1 |
| 2002/0097191 | A1 | 7/2002 | Harel et al. | |
| 2003/0119526 | A1 * | 6/2003 | Edge | 455/456 |
| 2006/0019710 | A1 * | 1/2006 | Ylitalo | 455/562.1 |
| 2006/0048577 | A1 * | 3/2006 | Haque et al. | 73/599 |
| 2006/0114148 | A1 | 6/2006 | Pillai | |
| 2006/0192711 | A1 | 8/2006 | Haskell | |
| 2007/0080886 | A1 | 4/2007 | Thomas et al. | |
| 2007/0194986 | A1 | 8/2007 | Dulmovits et al. | |
| 2009/0006010 | A1 | 1/2009 | Van Sloun et al. | |
| 2009/0072921 | A1 * | 3/2009 | Schmid | 332/145 |
| 2011/0055886 | A1 * | 3/2011 | Bennett et al. | 725/116 |

FOREIGN PATENT DOCUMENTS

| | | |
|---|---|---|
| JP | 2001326525 | 11/2001 |
| WO | 95/34102 | 12/1995 |
| WO | 00/55938 | 9/2000 |
| WO | 2004/030147 | 4/2004 |

OTHER PUBLICATIONS

Antenna array. (2001). In Hargrave's communications dictionary, Wiley. Retrieved from http://search.credoreference.com/content/entry/hargravecomms/antenna_array/0.*

Block. (2011). In The American Heritage dictionary of the English language. Retrieved from http://search.credoreference.com/content/entry/hmdictenglang/block/0.*

Feedback loop. (2011). In The American Heritage dictionary of the English language. Retrieved from http://search.credoreference.com/content/entry/hmdictenglang/feedback_loop/0.*

Examination Report dated Jul. 16, 2010 issued in EP Application No. 09156963.2.

Examination Report dated Mar. 9, 2012 issued in GB Application No. 0805826.5.

Levitas et al, Practical Failure Compensation in Active Phased Arrays, IEEE Transactions on Antennas and Propagation, vol. 47 (3), Mar. 1999, pp. 524-535.

Parker et al, Phased Arrays—Part 1: Theory and Architectures, IEEE Transactions on Microwave Theory and Techniques, vol. 50 (3), Mar. 2002, pp. 678-687.

* cited by examiner

METHOD AND APPARATUS FOR POWER LOSS COMPENSATION AND SUPPRESSION OF SIDELOBES IN ANTENNA ARRAYS

PRIORITY APPLICATIONS

This application is a continuation of U.S. application Ser. No. 12/415,195, filed Mar. 31, 2009. This application also claims the priority of U.S. Provisional Application 61/040,887, filed Mar. 31, 2008 and UK Patent Application GB0805826.5, filed Mar. 31, 2008. The entire disclosure of each of the foregoing applications is incorporated herein by reference.

FIELD OF THE INVENTION

The invention relates to an antenna array for the transmission of signals which actively compensates for power losses by up tilting the antenna pattern and actively suppresses the sidelobes.

BACKGROUND TO THE INVENTION

Passive micro or macro antennas, for example antennas used in mobile radio communications, comprise an antenna network with power splitters, passive amplitude tapers (attenuators) and passive phase shifters to feed multiple ones of antenna elements which form the antenna array. Each one of the individual antenna elements has a radiation pattern which is superposed and results in an overall radiation pattern of the antenna array in the far field. Typically, the antenna array will be arranged in a vertical manner (one column) and each of the antenna elements in the antenna array will be uniformly excited. The resulting vertical radiation pattern has a main lobe with a 3 dB half-power beam width and several sidelobes which are symmetrically arranged on both sides of the main lobe. In many situations, the several sidelobes are not an issue as long as the main lobe is pointing to the horizon and the goal of the antenna array is to maximise coverage. However, in cellular communication systems, it is necessary to have a limited coverage of the antenna array which corresponds to the size of a cell fed by the antenna array. Since cellular communication systems are limited by interference between adjacent ones of the cells, the goal of the antenna array in such cellular communication systems is to reduce as much as possible any interference from the antenna arrays arranged in adjacent ones of the cells. This reduction is implemented by the selection of correct frequencies and planning the cells based on topology data and wave tracing models. It is found in practice, that real propagation conditions are different from those which are predicted. For this reason, the antenna array can physically be "downtilted" so that the main lobe does not point at the horizon but towards the ground. The downtilting is done either by a mechanically driven or an electrical tilt mechanism. One disadvantage of the mechanical downtilting of the antenna array is that a first (upper) one of the sidelobes above the main lobe could point to the horizon and as a result cause unwanted interference with the adjacent ones of the cells. The consequence is that the fixed side lobe suppression of the antenna array needs to be designed in such a way that, for all of possible downtilt values, the worst case side lobe suppression is fulfilled. This is typically implemented by fixed amplitude tapering that results in a lower overall gain of the antenna array.

In the case of active antenna arrays which have transceivers attached to each one of a plurality of antenna elements, a flexible downtilting can be achieved by beam forming. The beam forming is implemented by multiplying individual complex values to each one of the individual transmission signals per antenna element. The advantage of beam forming through active antenna arrays compared to passive antenna arrays is that the downtilt is easily adjustable by digital signal processing instead of mechanically or by the electrical motors. In contrast to the mechanical downtilting, the physical phase shifting or digital beam forming affects the relationship between the main lobe and the sidelobes. This change in relationship can result in the transmission of unacceptable interference to adjacent ones of the cells in particular, if the beam pattern is tilted far down low. To avoid this one has to design the relation between effective radiated power in the main beam and the required sidelobe suppression independent on the tilt setting, i.e. it requires an inefficient worst case design.

A further issue which is known to occur in active antenna arrays is the failure of individual ones of the transceivers. The failure of the transceivers will not only result in an overall power degradation of 1/M (M being the total number of active elements) but also in a distortion of the radiation patterns. The distortion of the radiation pattern primarily results in the increase of the strength of the sidelobes which can also cause unwanted interference in adjacent ones of the cells.

A similar problem also occurs in horizontal or two-dimensional beam forming using multidimensional antenna arrays. If, for example, the beam forming is used in spatial-division multiple access (SDMA) techniques the goal of the antenna array is to point its power only to a particular point of interest and to produce low intracell interference outside of the main lobe.

PRIOR ART

In order to overcome the known problems the prior art solutions suppress certain ones of the sidelobes of the antenna arrays. This sidelobe suppression is implemented in passive antenna array structures, for example, by fixing the attenuation of the feeding signal of the antennas such that the antenna elements near the edge of the antenna array are attenuated whereas the centre elements may have larger amplitudes. This design could lead to an overall antenna gain loss of 0.3 dB.

Another known solution is to use passive phase shifting which would result in 0.2 dB output power losses. A further known solution is to apply spatial filter functions, like Tschebyscheff, which are used to filter the beam whilst accepting a certain output power backoff for some of the antenna elements.

To implement a similar sidelobe suppression by amplitude tapering using the active antenna array as compared to the passive antenna array, the M individual transceivers need to be optimized at individual output power levels dependent on the position of the individual transceivers within the active antenna array. This significantly reduces the flexibility of use of the M individual transceivers. The manufacture of different sizes of the antenna arrays with different antenna gains and different numbers of the M individual transceivers would require individual design of the different individual transceivers which is not advantageous for mass production of the individual transceivers. However, having only individual ones of the transceivers with identical constant maximum output power and applying amplitude tapering to achieve state of the art side lobe suppression would result in output power losses in the range of 2.5 dB.

The phase shifts required for beam forming a beam towards a certain angle depend on the distance between the antenna elements, the wavelength of the transmission signal and the direction of departure of the signal. Thus, knowing the direction of departure of the signal, the individual phase shifts needed at the individual ones of the M antenna elements to form the beam can be calculated. In reality, due to imperfection in the manufacture of the antenna array and/or the antenna elements, this calculation is not exactly true. As a result, the antenna array has to be calibrated during manufacture by measuring the beam pattern for different ones of the direction of departure and deriving a set of M phase shifts for each direction of departure. The sets of M phase shifts can be stored in a look-up table.

One example of an active array antenna for use in a radar system is disclosed in the U.S. Pat. No. 5,515,060 (Hussain et al., assigned to Martin Marietta Corp.). The '060 patent discloses a phase controller which controls the phase shift which is imparted by each transceiver to its signal and thus forms a main beam and its associated sidelobes. A perturbation phase generator portion of the phase controller adds a perturbation phase shift to form a relatively wide null in the sidelobe structure.

Another example of a radio system which relates to compensation of radiation patterns in case of disconnected antenna branches is given in the PCT patent application no. WO 2004/030147 (Ylitalo et. al., assigned to Nokia Corp.). The intension of this invention is to readjusting the beam in case of disconnected antenna branches in order to reform the original pattern as closely as possible. This is of high importance, in particular for space division multiple access methods. The recalculation and weighting of the antenna branches is done at the base station and not locally to the active antenna that is separated from the base station by a digital radio interface. Furthermore, no failure detection or monitoring mechanism is in place which monitors each transceiver and autonomously decides on switching to a compensation pattern in case of a detected failure and which allows for reintegration of failed transceivers when they are functional again. Finally, the proposed solution in WO 2004/030147 is presumably described for an analogue transmission which requires additional recalibration of the functional antenna branches after recalculation of the signal weights. With a conventional digital to analogue conversion and an analogue RF signal processing it requires high complexity to achieve the required accuracy of phase shifts for beam forming by micro alignment of the individual phases of each transceiver. In a digital transmission system with digital up- and down conversion the signal is transformed from a digital signal of low frequency to a digital signal of high frequency and no new calibration is required after applying changed signal weights.

Another related example in WO 00/55938 (Redvik, et. al., assigned to Telefonaktiebolaget LM Ericsson) describes an algorithmic approach to calculate patterns after antenna elements failed.

Furthermore, JP 2001326525 (Kanazawa, et. al., assigned to Comm Res Lab) discloses a concept for maintaining a good user interferer separation for space division multiple access systems even in the case of an error in the phase control system of the antenna array.

SUMMARY OF THE INVENTION

The invention provides an antenna array system for the transmission of signals with a digital radio interface for connecting the antenna array with a transmitter and/or receiver, and an antenna array with a plurality of antenna elements connected to a plurality of digital transceivers including digital up- and down conversion. The plurality of digital transceivers receives transceiver signals for transmission to the plurality of antenna elements. The antenna array also has a signal processor connected to the plurality of transceivers and which is adapted to weight, using complex values, the transceiver signals for automatically compensating for power losses by tilt adjustments and for interference by adjusting sidelobes of the signals. This adjustment of the sidelobes allows interference from sidelobes to be reduced. Hence, the antenna array allows the generation of an antenna pattern which is optimized for each tilt value in terms of the relationship between effective radiated power and required sidelobe suppression.

The antenna array has in one aspect a failure detector or monitoring system connected to the plurality of digital transceivers. The failure detector or monitoring system autonomously detects malfunction of the individual transceivers and reports this to the signal processor without involvement of the transmitter and receiver.

The antenna array has in one aspect of the invention a look-up table with the complex values used for weighting the transceiver signals. The complex values are in one aspect of the invention obtained from measurements.

The failure detector detects failures of one or more of the plurality of transceivers. When the failure detector detects a failure of one or more of the plurality of transceivers, the signal processor can weight the transceiver signals to adjust the sidelobes of the signals and compensate for the power loss due to the failure by automatically lifting the downtilt angle of the antenna by a predefined angle depending on the original tilt angle without failure.

The failure detector may comprise a feedback loop from at least one of the transceivers. The feedback loop may be used to convey a measured signal and/or data relative to the operation of the transceiver to the failure detector or monitoring and control system. The failure detector or monitoring and control system may analyze the feedback signal and/or the transceiver operation data and decide how to modify the complex values of individual transceivers.

The failure detector or monitoring and control system may further or alternatively comprise a data polling unit. The data polling unit may collect state data from at least one of the transceivers. The state data could be for example a measured signal strength at the transceiver or the temperature of the transceiver.

The invention also provides a method for adjusting the sidelobes and the downtilt angle of the signals transmitted from the plurality of antenna elements. The method comprises detecting the requirement to adjust the sidelobes and downtilt angle and adjusting the weights of transceiver signals feeding the antenna elements such that the sidelobes and the downtilt angle are adjusted.

In one aspect of the invention, the method further comprises detecting which at least one component of the antenna array is malfunctioning (or failing) and selecting the weights of the transceiver signals, such as to adjust the sidelobes and thereby compensate the malfunctioning of the at least one component.

The invention also provides a mechanism to reintegrate failed transceivers and to reset the weighting of the signals to its original values when the transceiver is functional again.

One aspect of the invention relates to the usage of digital transceivers comprising at least one of digital up- and down converters for up/down converting the signals digitally from baseband to RF and vice versa. The digital up conversion transforms a low speed digital signal into a high speed digital signal. Due to the fact the RF signal is still digital, any micro phase and time alignments of the signals of the individual transceivers which are required to form a proper beam can be realized with low complexity.

DETAILED DESCRIPTION OF THE INVENTION

Figure 1A:
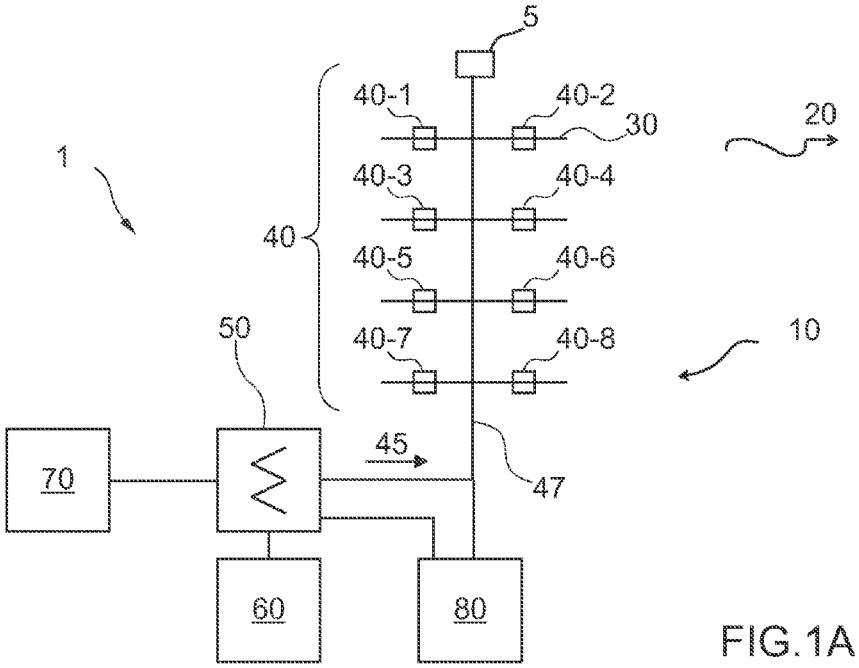
FIGS. 1A and 1B show an overview of an active antenna array system.
Figure 1B:
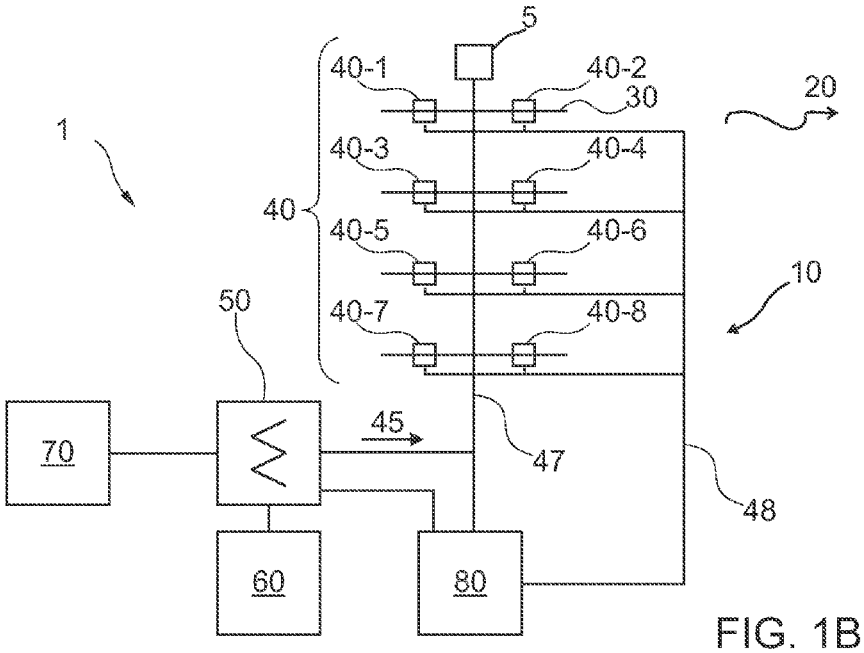

FIGS. 1*a* and 1*b* show an overview of an antenna array s stem 1 for the transmission of signals comprising a digital radio interface 5 and an active antenna array 10 according to an aspect of the invention. The active antenna array 10 has a plurality of antenna elements 30 for transmission and reception of signals 20. Each of the antenna elements 30 is connected to a transceiver 40-1-40-8 (collectively 40). In FIGS. 1*a* and 1*b* eight antenna elements 30 and eight transceivers 40 are shown. This is, however, only illustrative and the invention is not limited to this number of transceivers 40 and/or antenna elements 30. The transceivers 40 are connected to a signal processor 50 by means of a cable 47. The cable 47 in this aspect of the invention comprises eight individual cables leading from the signal processor 50 to separate ones of the transceivers 40. The transceivers 40 may be digital transceivers 40 whereas the signals transmitted via the cable 47 are digital signals. The signal processor 50 produces eight individual transceiver signals 45 for each ones of the antenna elements 30 as will be described below. The signal processor 50 receives from a base station 70 the digital signals for transmission by the active antenna array 10. Furthermore, the signal processor receives signals from the antenna elements 30 for providing a weighted combination of the received signals to the base station 70. The signal processor 50 is further connected to a look-up table 60 which contains complex values which are to be multiplied with each of the transceiver signals 45 as will be explained below. Furthermore, the signal processor is connected to a monitoring and control unit 80 that monitors the functionality of each individual transceiver 40-1-40-8 as will be described below. Two embodiments of the invention are illustrated in FIGS. 1*a* and 1*b*.

The signal processor 50 receives the signal from the antenna 30 and combines the eight different signals for transmission to the base station 70. The signal processor 50 weights the individual ones of the transceiver signals 45 using the complex values that define a receive antenna pattern and which are looked up in the look-up table 60. The complex values in the look-up table 60 result in either the phase of the transceiver signals 45 and/or the amplitude of the transceiver signals 45 being altered.

The complex values in the look-up table 60 could be calculated for each possible direction of departure of the transmitted signal 20 and for each possible failure of one of the antenna elements. It is, of course, not possible to store complex values in the look-up table 60 for all possible combinations of the direction of departure and the number of antenna elements. A selection of complex values is therefore made which is usable in practice. For example the tilt of the transmission signal could be between 0° and 14° and in steps of 1°. Therefore, the complex values are stored for each of the normal operation of all of these values of the tilt. It is also reasonable to assume that not all of the antenna elements 30 will fail at any one time. It is reasonable, to assume, for example, that only a maximum number of two or four of the transceivers 40 will fail at any moment. If more of the transceivers 40 fail it is likely that the active antenna array 10 will need to be repaired. For each of these combinations and for each direction of departure value at least two phase shifts for two selected ones of the antenna elements 30 are required. Assuming a maximum failure (or other malfunctioning) of two of the transceivers out of eight of the possible transceiver failures and knowing the combination of failures and the direction of departure value it is possible to select approximately 28 acceptable failure combinations to add to the 14 direction of departure values. As a result only 392 complex values need to be stored in the look-up table 60 (i.e. no amplitude change). In the case that only phase shift is used for pattern correction, only the 392 complex values for the phase shift needs to be stored. Hence, in case of an eight bit coding per phase value 3136 bits have to be stored in the look-up table 60. If smaller step sizes for the direction of departure values than 1° are required, either more complex values have to be stored or any additional needed phase correction for any interim step could be obtained from an interpolation of the available complex values.

Figure 2A:
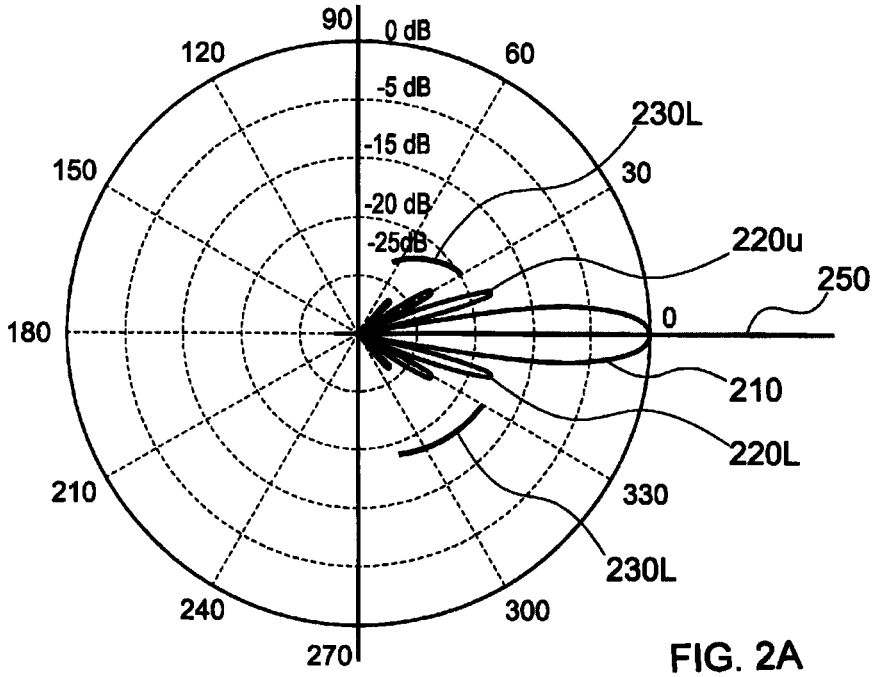
FIGS. 2A and 2B show antenna array patterns without tilting and without transceiver failure.
Figure 2B:
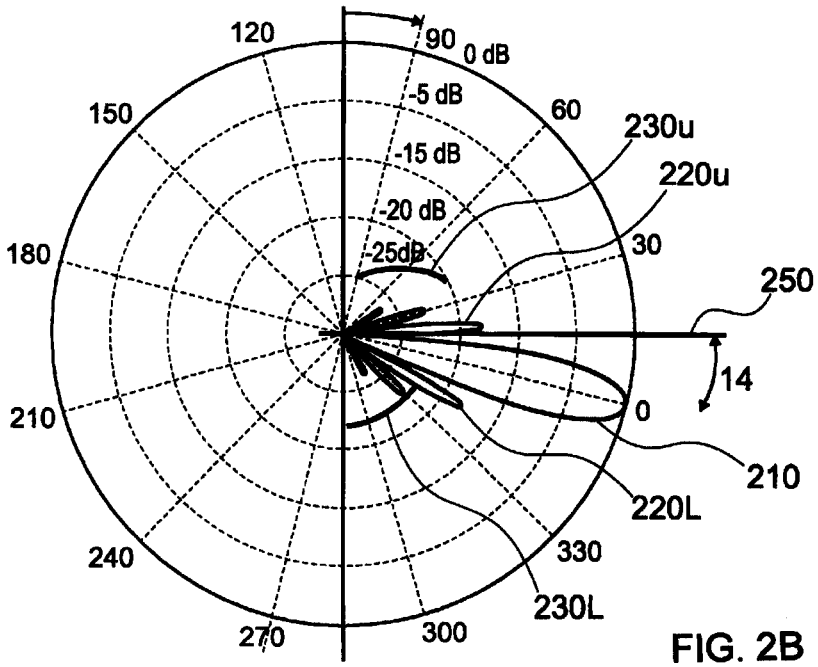

In order to understand the system more clearly, let us take an example of a normal operation. This is shown with respect to FIGS. 2A and 2B which show the active antenna array 10 which is not tilted and in which all of the transceivers 40 are functioning correctly. In this example, the line 210 shows the main lobe 210 of the transmission signal 20. It will be seen from the figure that the main lobe is at 0° tilt and that the sidelobes 220*u* and 220*l* (as well as other sidelobes collectively noted as 230*u* and 230*l*) are symmetrically arranged about the main lobe 210. Using the complex values from the look-up table 60 the transceiver signals 45 to the transceivers 40 can be weighted within the signal processor 50 and the upper sidelobe 220*u* suppressed (FIGS. 2A and 2B). In FIGS. 2A and 2B it will be noticed that the lower sidelobe 220*l* as well as the further lower sidelobes 230*l* are tilting downwards and are now stronger than the upper sidelobe 220*u* (and other upper sidelobes 230*u*) directed upwards. This is advantageous as the lower sidelobes 220*l* and 230*l* tilting downwards point within the cell and cannot interfere with the transmitters in other cells. The upper sidelobes 220*u* and 230*u* tilted upwards risk interference with adjacent cells and therefore it is advantageous to reduce the size of the upper sidelobes 220*u* and 230*u* substantially.

Figure 3:
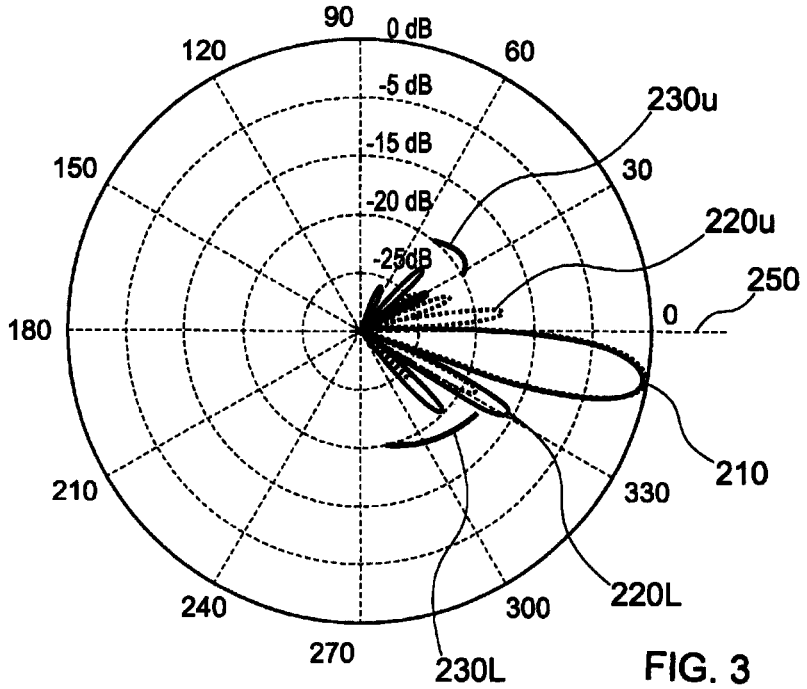
FIG. 3 shows an antenna array pattern with tilting but without transceiver failure.

A further example of sidelobe suppression but with tilting is shown in FIG. 3. It will be noticed in this figure that the main lobe 210 is now pointing at approximately 14° downwards. It will be further noted that the upper sidelobes 220*u* and 230*u* which are without suppression will be a little above the zero tilt (i.e. pointing to the horizon). As a result the first upper sidelobe 220*u* risks interfering with the adjacent cell. On applying the complex values from the look-up table 60 to the transceiver signals 45 it is possible to suppress the upper sidelobe 220*u* and increase the strength of the lower sidelobe 220*l*. It will be noticed, however, that some of the other upper sidelobes 230*u* are increased in strength. This is, however, not a problem because these other upper sidelobes 230*u* are tilted at a about 50° upwards and are unlikely to interfere with transmissions from an adjacent cell. As explained with respect to FIGS. 2A and 2B the increase in the amplitude of the lower sidelobes 220*l* and 230*l* is also not a problem as these do not transmit power into an adjacent cell.

Figure 4:
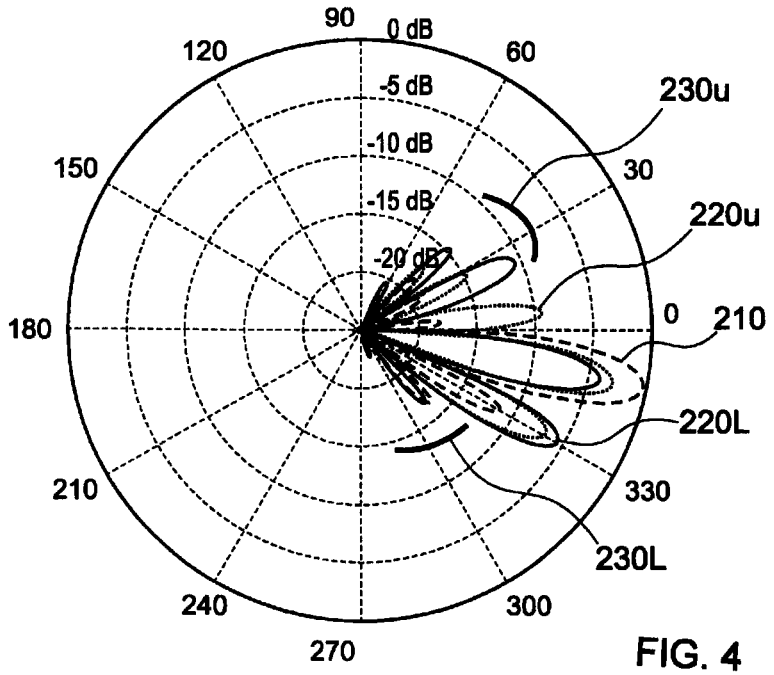
FIG. 4 shows an antenna array pattern with tilting and with transceiver failure.

FIG. 4 now shows an example in which the direction of departure is tilted at 14°. A failure (or other malfunctioning) of one of the transceivers is assumed under several conditions. These conditions include the connection between central processing unit and an individual transceiver being down or no longer existent, the current and voltages of the power supply units of the transceivers being out of their normal ranges, the temperature sensors at the transceivers detecting an increased temperature, or unacceptable deviations from the required output power are detected. It is also conceivable that one of the transceivers needs to be switched off for another reason. The transceiver can recover in case the cause that forced the system to shut down the transceiver is removed. In one aspect of the invention a central controller unit 80 supervises the determination as to whether a defined "failure" occurs, if predefined conditions are met.

On failure of two of the transceivers 40 the first upper sidelobe 220*u* is substantially increased in amplitude as is shown by the line in FIG. 4. Thus, if the complex parameters on the transceiver signals 45 were not amended, there would be substantial increase in interference with the transmitters in adjacent cells. In order to minimize this problem, new complex values are fetched from the look-up table 60 and are used to weight these transceiver signals 45 in the signal processor 50. This results in an amended weight adjusted antenna array pattern as is shown by the further line in FIG. 4. It will be noted, that the amplitude of the main lobe 210 is reduced (as would be expected because two of the transceivers 40 are not working). However, the amended complex values lead to a substantial reduction in the amplitude of the first upper sidelobe 220*u*, but to an increase in the amplitude of the second upper sidelobe 230*u*. Again the increase in the amplitude of the second upper sidelobe 230*u* is not an issue because this second upper sidelobe 230*u* is tilted at approximately 25° and as a result does not interfere with the adjacent cell. Due to the failure of the transceivers 40-4 and 40-5 in the middle of the antenna array 10 the gain of the main lobe 210 is reduced by 2.84 dB due to the lower overall output.

In addition to the sidelobe suppression the monitoring and control unit 80 can notify the signal processor to use for the given failure scenario an antenna pattern with a pre-defined lifted tilt value. Lifting the tilt angle can compensate for the coverage loss that goes along with the loss of the output power or the sensitivity that occurs when at least one transceiver of the antenna array is non-operational.

Figure 5:
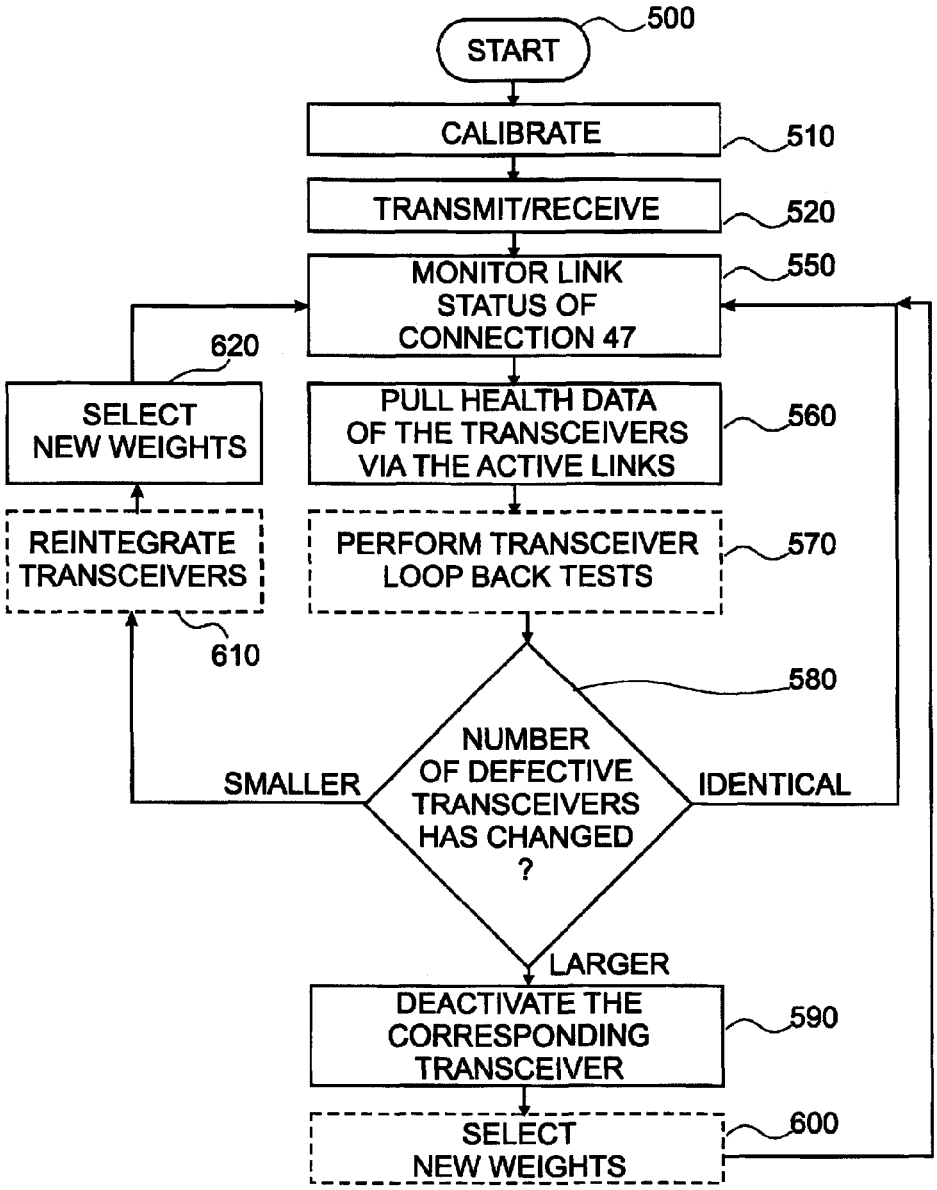
FIG. 5 shows a flow chart for the method of operation of the invention.

FIG. 5 shows a flow chart for the method according to the invention. In a first step 500 the active antenna array 10 is switched on and a calibration takes place in step 510. The calibration step 510 involves adding the complex values to the look-up table 60 which are required for the particular location of the antenna array. The complex values are determined dependent on simulations of the pattern of the antenna array 10 and the heuristic approach to find the side lobe optimum dependent on the failure scenario, the wanted direction of departure and the restriction on how many phases shall be corrected. The complex values can also be determined by measuring the antenna pattern and correcting manually the phases until an optimum side lobe suppression is achieved. The complex values will correspond to the sidelobe suppression and the degree of tilt required at the location in which the antenna array 10 is situated. The pattern correction is not only valid for the transmission of signals but also for reception of the signals.

In step 520 the transmission signals 20 are transmitted from the active antenna array 10 and will, of course, be received by receivers in the cell and signals from transmitters in the cell are received by the array.

According to the one realization of the system shown in FIGS. 1A and 1B in step 550 the link states of each connection between the signal processor 50 and each transceiver 40-1-40-8 is monitored. Furthermore, this realization of the system considers an initial transceiver health data collection (e.g. current and voltages, temperature, etc.) locally done by a health data collector at each transceiver 40-1-40-8 whereas the data is digitally provided to the monitoring and control unit 80 via cable 47. This is shown in step 560 of the corresponding flow chart of FIG. 5. The monitoring and control unit 80 extracts the digital health data from the transceiver signals which are also transmitted via the cable 47. Based on the collected information and based on monitoring the digital link status of each transceiver 40-1-40-8 on cable 47 the monitoring and control unit 80 in step 580 gives information about non-operational transceivers to the signal processor 50 or triggers the signal processor 70 to switch off either the transmit or the receive functionality or both of patent application Ser. No. 12/415,195 individual transceivers 40-1-40-8 as in step 590. The monitoring and control unit 80 may also provide information about which of the transceivers shall be reintegrated again according to step 610. Based on the information which transceiver is not operational any more or which transceiver needs to be reintegrated the signal processor 50 can chose the appropriate weights for beam forming from the lookup table 60 independently for the transmit and the receive direction in step 600 and 620, respectively. Another realization of the system is illustrated in FIGS. 1A and 1B and considers the monitoring and control unit to be connected to the signal processor 50 and to each transceiver via an analog connection 48 in order to enable loop back tests of the receive and the transmit functionality of each transceiver using the loop from the monitoring and control unit 80 via the signal processor 70, the transceivers 40 and back to the control and monitoring unit 80 for transmit functionality tests and vice versa for receive functionality tests. This addition to the failure detection process is illustrated in step 570 in the flow chart in FIG. 5 by the dashed activity box.

According to the flow chart in FIG. 5, each non-operational transceiver continues to be included in the monitoring process. In case the monitoring and control unit 80 detects that a non-operational transceiver could become functional again, it autonomously decides to reintegrate the non-operational transceiver again to become active. The signal processor 50 chooses again the weights for beam forming from the look up table 60 which are valid for the fully functional antenna array without failure.

While various embodiments of the present invention have been described above, it should be understood that they have been presented by way of example, and not limitation. It will be apparent to persons skilled in the relevant arts that various changes in form and detail can be made therein without departing from the scope of the invention. For example, in addition to using hardware (e.g., within or coupled to a Central Processing Unit ("CPU"), microprocessor, microcontroller, digital signal processor, processor core, System on Chip ("SOC"), or any other device), implementations may also be embodied in software (e.g., computer readable code, program code, and/or instructions disposed in any form, such as source, object or machine language) disposed, for example, in a computer usable (e.g., readable) medium configured to store the software. Such software can enable, for example, the function, fabrication, modelling, simulation, description and/or testing of the apparatus and methods described herein. For example, this can be accomplished through the use of general programming languages (e.g., C, C++), hardware description languages (HDL) including Verilog HDL, VHDL, and so on, or other available programs. Such software can be disposed in any known computer usable medium such as semiconductor, magnetic disk, or optical disc (e.g., CD-ROM, DVD-ROM, etc.). The software can also be disposed as a computer data signal embodied in a computer usable (e.g., readable) transmission medium (e.g., carrier wave or any other medium including digital, optical, or analog-based medium). Embodiments of the present invention may include methods of providing the apparatus described herein by providing software describing the apparatus and subsequently transmitting the software as a computer data signal over a communication network including the Internet and intranets.

It is understood that the apparatus and method described herein may be included in a semiconductor intellectual property core, such as a microprocessor core (e.g., embodied in HDL) and transformed to hardware in the production of integrated circuits. Additionally, the apparatus and methods described herein may be embodied as a combination of hardware and software. Thus, the present invention should not be limited by any of the above-described exemplary embodiments, but should be defined only in accordance with the following claims and their equivalents.

The invention claimed is:

1. A method for adjusting sidelobes of signals transmitted from a plurality of antenna elements, the plurality of antenna elements being connected to a plurality of digital transceivers, whereby the plurality of digital transceivers receive transceiver signals for transmission to the plurality of antenna elements, the method comprising:

detecting a requirement to adjust the sidelobes, said detecting comprising a detection of malfunction of at least one individual transceiver of the antenna array;

adjusting weights of a plurality of transceiver signals feeding the antenna elements such that the sidelobes are adjusted and unacceptable deviations from the required radiated output power are compensated by tilt adjustments, wherein the unacceptable deviations comprises a coverage loss;

using a feedback loop for measuring signal and/or data relative to an operation of an individual transceiver of the plurality of transceivers for providing a feedback signal, the feedback loop being configured to detect a functionality of said individual transceiver and being further configured to detect whether a non functional transceiver could become functional again;

analyzing the feedback signal, and deciding how to modify complex value weights for transceiver signals of individual transceivers, based on information derived from the analyzed feedback signal.

2. The method of claim 1, further comprising:

detecting which at least one component of the antenna array is malfunctioning; and selecting weights of the transceiver signals, so as to adjust the sidelobes and thereby compensate the malfunctioning of the at least one component.

3. The method of claim 1, wherein the detection of the requirement to adjust the sidelobes comprises at least one of the detection of a malfunction of at least one component of an antenna array or the tilting of the antenna array.

4. The method of claim 3 further comprising collecting state data from at least one transceiver.

5. The method of claim 4 further comprising switching off either the transmit or the receive functionality or both of individual transceivers based on the collected state data.

6. The method of claim 4, wherein collecting state data from at least one of said transceivers comprises collecting measured received signal parameters.

7. The method of claim 4, wherein collecting state data from at least one of the transceivers comprises collecting measurement values indicative of the temperature of at least one of said transceivers.

8. The method of claim 1 comprising reintegrating failed transceivers when the transceiver is functional again and resetting the weighting of the signals to its original values.

9. The method of claim 1 comprising determining the complex values, the complex values defining an antenna pattern for tilt adjustments, by one of depending on simulation of the patterns from the plurality of the antenna elements measuring the antenna pattern and correcting manually the phases until an optimum side lobe suppression is achieved.

10. The method of claim 9 wherein the complex values comprise phase information of transceiver signals and/or amplitude information of transceiver signals and using these complex values.

11. The method of claim 1 comprising using the complex values defining an antenna pattern for weighting the individual ones of the transceiver signals.

12. The method of claim 11 comprising using the complex values defining an antenna pattern for lifting the tilt angle for compensating coverage loss that goes along with the loss of radiation output power or the loss of sensitivity that occurs when at least one transceiver of the antenna-array is non-operational.

13. The method of claim 1 comprising autonomously detecting malfunction of at least one individual transceiver and reporting detected malfunctions to a signal processor without involvement of the at least one transceiver.

* * * * *